US006183372B1

(12) United States Patent
Anderegg, Jr.

(10) Patent No.: US 6,183,372 B1
(45) Date of Patent: Feb. 6, 2001

(54) COMPRESSED GAS POWERED PUTTER

(75) Inventor: James A. Anderegg, Jr., 3056 Westwood Ct., Augusta, GA (US) 30909

(73) Assignee: James A. Anderegg, Jr., Augusta, GA (US)

( * ) Notice: Under 35 U.S.C. 154(b), the term of this patent shall be extended for 0 days.

(21) Appl. No.: 09/419,643

(22) Filed: Oct. 18, 1999

Related U.S. Application Data

(60) Provisional application No. 60/106,790, filed on Nov. 3, 1998.

(51) Int. Cl.[7] ..... A63B 53/00
(52) U.S. Cl. ..... 473/131; 473/382
(58) Field of Search ..... 473/131, 282, 473/313, 333, 337; 173/206, 90

(56) References Cited

U.S. PATENT DOCUMENTS

| | | | | |
|---|---|---|---|---|
| D. 303,559 | | 9/1989 | Florian . | |
| D. 317,193 | | 5/1991 | Florian . | |
| D. 367,095 | | 2/1996 | Snyder . | |
| 4,840,371 | | 6/1989 | Harris . | |
| 5,005,836 | * | 4/1991 | Nelson . | |
| 5,094,454 | | 3/1992 | Schering . | |
| 5,169,150 | | 12/1992 | Tindale . | |
| 5,169,151 | | 12/1992 | Conley . | |
| 5,332,222 | * | 7/1994 | Perry . | |
| 5,522,594 | * | 6/1996 | Taylor et al. | 473/131 |
| 5,632,693 | * | 5/1997 | Painter | 473/318 |
| 5,792,001 | | 8/1998 | Henwood . | |
| 5,860,869 | * | 1/1999 | Duncalf | 473/131 |
| 5,868,633 | | 2/1999 | Keheley . | |

* cited by examiner

*Primary Examiner*—Jeanette Chapman
*Assistant Examiner*—Stephen L. Blau

(57) ABSTRACT

A putter blade is attached to a pneumatic cylinder mounted in a putter head. Also attached to the head are a sealed hollow shaft (serving as a compressed gas reservoir) and a cleated foot. Mounted on the shaft are a pressure gauge, a pressure relief valve, a compressed air fill valve, a pneumatic switch, a hand grip, and pneumatic tubing and fittings connecting the shaft/reservoir, switch, and cylinder. Also attached to the shaft (removable) is a bicycle pump, used to fill the reservoir. After pressurizing the shaft/reservoir, pressing the pneumatic switch will stroke a golf ball without requiring the operator to swing the putter.

2 Claims, 2 Drawing Sheets

B - B

A - A

COMPRESSED GAS POWERED PUTTER

CROSS-REFERENCE TO RELATED APPLICATIONS

This application claims benefit of Provisional application Ser. No. 60/106,790 filed Nov. 3, 1998.

BACKGROUND OF THE INVENTION

1. Field of the Invention

This invention relates in general to sports/golfing; in particular it is a novelty golf club. It is also an amusement device that can be used in a game, or as a gift.

2. Description of the Prior Art

In order to provide background information so that the invention may be completely understood and appreciated in its proper context, reference may be made to several prior art patents and publications as follows:

U.S. Pat. No. D. 303,559, Novelty Golf Putter of Florian;

U.S. Pat. No. D. 317,193, Novelty Golf Putter Head of Florian;

U.S. Pat. No. D. 367,095, Novelty Golf Putter of Snyder;

U.S. Pat. No. 4,840,371, Novelty Golf Club with Programmed Sound Playing Device of Harris;

U.S. Pat. No. 5,094,454, Novelty Golf Club of Schering;

U.S. Pat. No. 5,169,150, Putting Stroke Correcting Device of Tindale;

U.S. Pat. No. 5,169,151, Electromechanical Putting Trainer of Conley;

U.S. Pat. No. 5,792,001, Putting Stroke Training Device, of Henwood; and

U.S. Pat. No. 5,868,633, Lighted Novelty Golf Club with Automated Sound Producing Means of Keheley.

U.S. Pat. Nos. D. 303,559 and D. 317,193 to Florian disclose ornamental designs for a novelty golf putter and a novelty golf putter head.

U.S. Pat. No. D. 367,095 to Snyder discloses another ornamental design for a novelty golf putter.

U.S. Pat. No. 4,840,371 to Harris discloses another novelty putter head that emits humorous sounds when a switch is activated in the putter head.

U.S. Pat. No. 5,094,454 to Schering discloses a novelty golf club with a bendable shaft.

U.S. Pat. No. 5,169,150 to Tindale discloses an electrical device for detecting and correcting alignment errors in a golfer's putting stroke.

U.S. Pat. No. 5,169,151 to Conley discloses an electromechanical putting swing trainer.

U.S. Pat. No. 5,792,001 to Henwood discloses a putter with a converter for converting mechanical energy to electrical energy for detecting and signaling when the putter head strikes the ball.

U.S. Pat. No. 5,868,633 to Keheley discloses a novelty putter head that emits humorous phrases when the head strikes any object.

Whatever the precise merits, features, and advantages of the above cited references, none of them achieves or fulfills the purposes of the compressed gas operation of the present invention.

Accordingly, it is a principal object of the present invention to achieve a putting stroke using compressed gas. None of the referenced patents, either novelty or non-novelty, use compressed gas for the motive power to strike a golf ball; the user must swing the putter to impart motion to the golf ball. Also, the novelty in the referenced patents is due to the various sounds that come from the putters, the design of the putters, or the ability to deform the putter.

BRIEF SUMMARY OF THE INVENTION

The first object of the present invention is to provide a lightweight novelty device for striking a golf ball, resembling a putter in its detail and powered by compressed gas. It is a further object of the present invention to provide such a device that is of simple, inexpensive construction. It is a further object to provide such a device that can be easily transported, such as in a golf bag or in the trunk of an automobile.

The foregoing objects can be accomplished by providing a device having compressed gas as the motive power for the blade, with a means for controlling the compressed gas. In the preferred embodiment of the invention, the device shaft (formed by a plurality of structural members) has the head mounted on the bottom end, and the means of compressed gas motive power (a pneumatic cylinder) is mounted within the head. The tubular structural members comprising the device shaft also serve as the gas reservoir for providing the motive power to the cylinder. The means for controlling the compressed gas to the pneumatic cylinder is a pneumatic switch mounted on the upper end of the shaft. The switch, cylinder, and shaft are interconnected with pneumatic tubing.

DETAILED DESCRIPTION OF THE INVENTION

While preferred embodiments of the present invention have been shown and described herein, it will be obvious that such embodiments are provided by way of example only. Numerous variations, changes and substitutions will occur to those skilled in the art without departing from the invention herein. Accordingly, it is intended that the invention be limited only by the spirit and scope of the appended claims.

Figure 1:
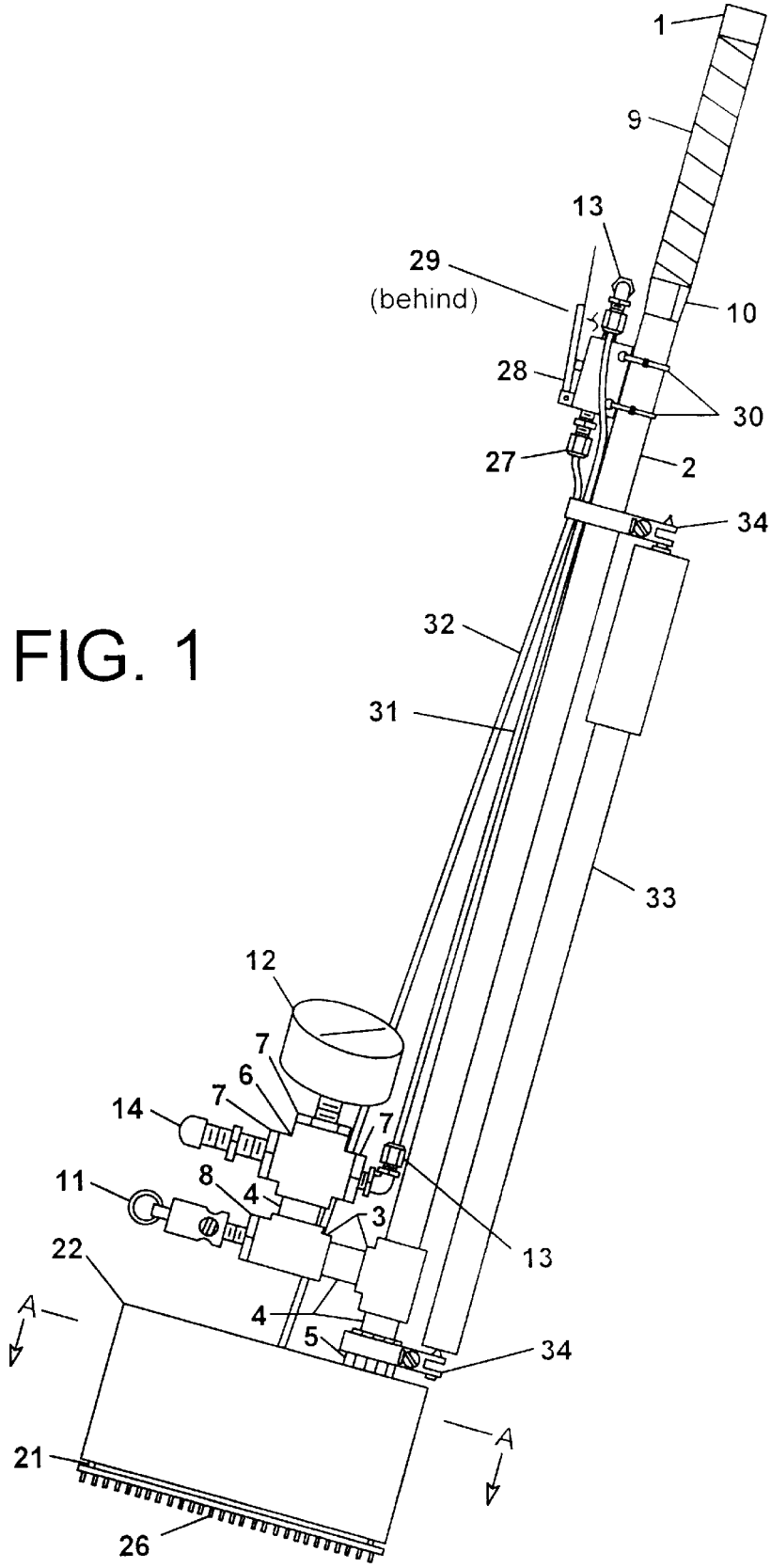
FIG. 1 is an elevation of the compressed gas powered device in accordance with the present invention.

As shown in FIG. 1 of the drawings, the preferred compressed gas powered device in accordance with the present invention comprises a shaft of structural tubular members and fittings (1 through 8), which preferably are of strong molded plastic, glued together. In this preferred embodiment, the shaft also serves as the compressed gas reservoir by having all openings in fittings and the ends of the shaft closed-up in one of several manners described below. The capped upper end of the shaft serves as the handle of the device around which is wrapped adhesive-backed foam insulation tape (9), to serve as the handgrip of the device. The bottom end of this grip is doubly secured-in-place with a short length of electrical tape (10). Mounted on the fittings of the shaft are a means for preventing overpressurization (a pressure relief valve, 11), a means for pressure indication (a pressure gauge, 12), a male pipe adapter elbow compression fitting (13), and a means to introduce compressed gas to the shaft/reservoir (a fill valve, 14).

Figure 3:
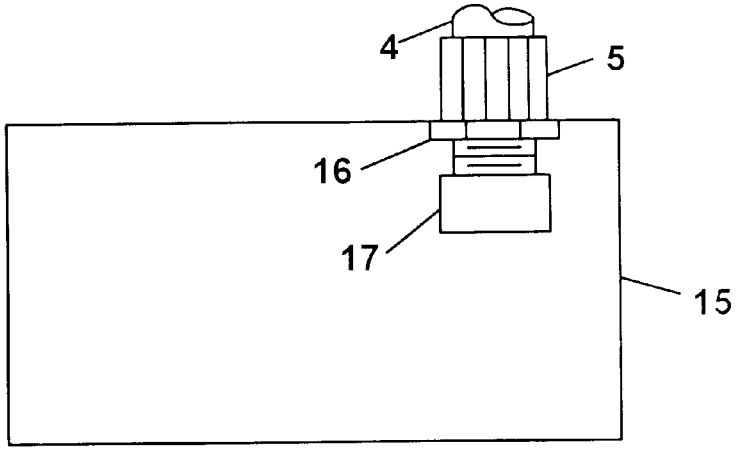
FIG. 3 is an elevation perspective of the shaft connection to the head.
Figure 2:
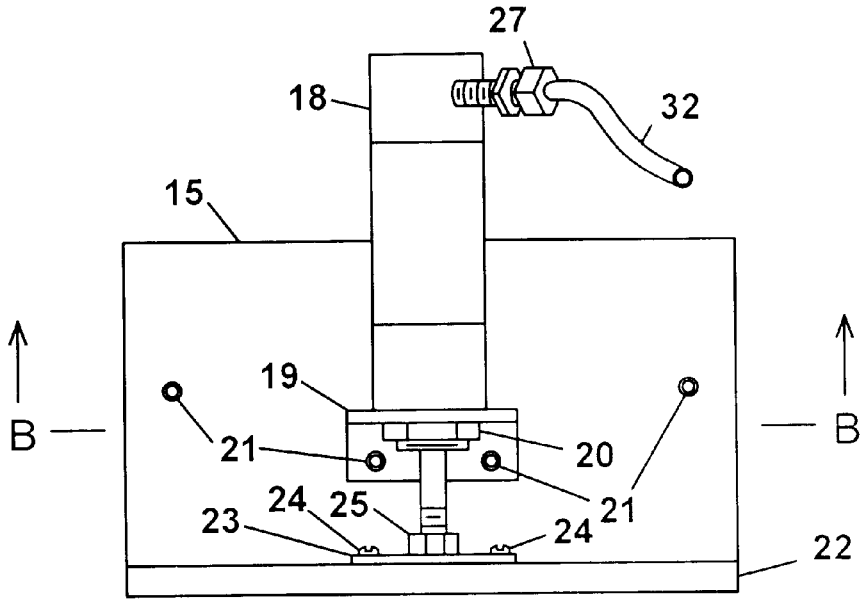
FIG. 2 is a top perspective of the interior of the head.

As shown in FIG. 3, the head (15) is mounted to the lower end of the shaft with the shaft locknut (16). In the preferred embodiment, an electrical mounting box is used for the head, with one of the top knockouts removed to create the mounting hole for the end of the shaft. After the head is mounted on the shaft, the threaded end cap (17) is installed, closing (as noted above) this end of the shaft. This threaded joint must be made with a means for sealing the pipe threads. In the preferred embodiment, the means for providing compressed gas motive power to the blade is a pneumatic cylinder (18), which is mounted within the head: the cylinder mounting bracket (19, shown in FIG. 2) is attached to the cylinder using the cylinder mounting nut (20), and this cylinder/mounting bracket assembly is attached to the head with two rivets (21). The center back knockout of the head is removed to make space for the end of the cylinder, and two holes are drilled in the bottom of the head to accept the rivets used to hold the cylinder mounting bracket. Mounted on the end of the pneumatic cylinder shaft is the blade (22). The blade mounting bracket (23, shown in FIG. 2) is attached to the back of the blade with two screws (24). The blade mounting bracket locknut (25) is installed onto the cylinder shaft, after which the blade with attached mounting bracket is also installed on the shaft. When the blade is in the proper position, the locknut (25) is tightened against the blade mounting bracket to hold the blade in place. In the preferred embodiment, the means to hold the device stationary during use is a cleated foot (26) attached to the bottom of the head with two rivets (21) through holes drilled in both the bottom of the head and in the foot.

After the cylinder/mounting bracket assembly is installed in the head, a straight male pipe compression fitting (27) is threaded into the cylinder inlet port. In the preferred embodiment, the means for controlling the compressed gas is a pneumatic switch. The pneumatic switch/tube fitting assembly is assembled by threading another straight male pipe adapter compression fitting (27) into the outlet of the pneumatic switch (28) and the street elbow (29) into the inlet of the switch. This assembly is completed by threading a male pipe adapter elbow compression fitting (13) into the street elbow (29). Each of these threaded joints must be made with a means for sealing the pipe threads. This assembly is then mounted on the shaft near the handgrip and held in place with two cable ties (30). In the preferred embodiment, pneumatic tubing is the means for transmitting the compressed gas: after the switch has been mounted, one length of tubing (31) is installed between the shaft and switch inlet male pipe adapter elbow compression fittings and another length of tubing (32) is installed between the switch outlet and cylinder inlet male straight pipe adapter compression fittings.

In this preferred embodiment, the means of introducing compressed gas to the reservoir is a bicycle pump (33); the two mounting straps (34) provided with the pump are installed on the shaft as shown in FIG. 1, after which the pump is mounted on the shaft on these straps.

In use, the pump (33) is detached from the shaft of the device, connected to the compressed gas fill valve (14), and used to increase the gas pressure in the shaft/reservoir up to the setpoint of the pressure relief device (11), noted on the gauge (12). It should be noted that the pressure relief device (11) is for safety in case the shaft is overpressurized, since the shaft can be pressurized from an automatic compressed air source (e.g., tank or compressor), as well as from the supplied pump.

With the shaft pressurized, place the blade directly behind a golf ball and depress the actuating lever of the pneumatic switch (28). The pneumatic cylinder will extend quickly, stroking the ball with the blade. With practice, the operator can control the speed at which the ball is propelled by controlling the speed at which the lever is depressed, thereby controlling the compressed gas flow to the cylinder. Operating the putter at reduced pressures (below the setpoint of the pressure relief device) will also vary the putter stroke speed.

What is claimed is:

1. A novelty device made to resemble a putter comprising a compressed gas reservoir, a means for introducing compressed gas to said reservoir, a means for indicating the pressure of said reservoir, a means of preventing overpressurization of said reservoir, a device head and blade, a means for providing motive power to said blade by the compressed gas in said reservoir, a means for controlling said compressed gas, and a means for transmitting said compressed gas between said reservoir, said means for providing motive power and said means for controlling said compressed gas.

2. The device of claim 1 with a means for gripping and a means for holding said device head stationary during use.

* * * * *